United States Patent [19]

Saukkonen

[11] Patent Number: 4,842,209

[45] Date of Patent: Jun. 27, 1989

[54] METHOD AND DEVICE IN THE WINDING OF A WEB

[75] Inventor: Seppo Saukkonen, Vantaa, Finland

[73] Assignee: Valmet Paper Machinery Inc., Helsinki, Finland

[21] Appl. No.: 194,444

[22] Filed: May 16, 1988

[30] Foreign Application Priority Data

May 20, 1987 [FI] Finland ..... 872223

[51] Int. Cl.[4] ..... B65H 16/10

[52] U.S. Cl. ..... 242/56 R; 242/66; 242/67.1 R

[58] Field of Search ..... 242/56, 66, 65, 67.1 R

[56] References Cited

U.S. PATENT DOCUMENTS 4,635,867 1/1987 Kytönen ..... 242/56 R 4,746,076 5/1988 Tomma et al. ..... 242/66

*Primary Examiner*—David Werner

*Assistant Examiner*—John M. Eghtessad

*Attorney, Agent, or Firm*—Dellett, Smith-Hill and Bedell

[57] ABSTRACT

A web (P) is wound onto a core (17) while supported by a first carrier roll (11) and by a second carrier roll (12) and while a press roll (14) presses the web reel (13) that is being wound. The second carrier roll (12) is a carrier roll consisting of a set of belt rolls. The complete web reel is removed by means of a lowering device (15). During the lowering movement of the reel, a new core (17) is shifted into the gap between the first carrier roll (11) and the second carrier roll (12). The web (P) is cut off, and the cut-off end of the web (P) is attached to the core. The winding is slowed down to the exchange speed, nonstop, or to a stop, and the press roll (14) is raised off the complete reel (13) and shifted rearwards relative the complete reel (13). The set (12) of belt rolls is displaced in the lateral direction, and a new core (17) is shifted into the space defined the first carrier roll (11), the first roll (18) in the set (12) of belt rolls, and the complete reel (13). The set (12) of belt rolls is displaced back in the lateral direction, and the press roll (14) is displaced towards the new core (17), whereby the press roll (14) is, at the same time, positioned to push the complete reel (13) away from the first carrier roll (11). Substantially at the same time the second roll (19) in the set (12) of belt rolls is lowered in the vertical direction, whereby the complete reel (13) is positioned for transfer to the lowering device (15).

20 Claims, 6 Drawing Sheets

METHOD AND DEVICE IN THE WINDING OF A WEB

The invention concerns a method in the winding of a web, in which said method the web is wound onto a core while supported by a first carrier roll and by a second carrier roll, of which said carrier rolls at least the second carrier roll is a carrier roll consisting of a set of belt rolls, and while a press roll presses the web reel that is being wound, in which said method the complete web reel is removed by means of a lowering device, that partly substantially simultaneously with the reel lowering movement a new core is shifted into the gap between the first carrier roll and the second carrier roll, and that the web is cut off and the cut-off end of the web is attached to the core.

The invention further concerns a device for winding a web onto a core, which said device includes a first carrier roll, a second carrier roll, of which said carrier rolls at least the second carrier roll is a carrier roll consisting of a set of belt rolls, and a press roll pressing the web reel that is being wound onto the core, whereat the first carrier roll forms a first nip with the reel and, in a corresponding way, the second carrier roll forms a second nip with the reel, and at least one of said carrier rolls is a driven carrier roll which is fitted so as to rotate the core and the reel that is wound around the core, and by means of which said device the web is cut off and the cut-off end of the web is attached to the core.

When a web is being wound, in a situation of change of the web, it is always necessary to stop the large and heavy so-called reeling drum, and after a core or cores have been shifted onto the carrier-roll winder, the reeling drum must be started again. With the present winding speeds of about 2000 m/min., the braking of the large and heavy reeling drum wears the constructions and the stopping takes time. Re-starting of the large and heavy reeling drum requires a lot of electric energy. At present, the exchange time in the winding of a web is, when mechanized solutions are used, about 30 seconds, and when the cores are placed manually, about 2 minutes.

In respect of the prior art, reference is made to the Finnish Pat. No. 63,918, wherein an arrangement is suggested for the winding of a paper web or equivalent onto a winding core or equivalent in a carrier-roll winder. A carrier-roll winder includes carrier rolls and a press roll or equivalent that keeps the web reel that is being formed in contact with the carrier rolls, means for shifting a new winding core at the final stage of the winding of the preceding web reel in between said web reel and the carrier rolls, a web cutting device, as well as means for shifting the complete reel away from between the carrier rolls and the press roll. This prior-art solution further includes means for guiding the cut-off end of the web around the new winding core, which said means comprise guide devices placed at different sides of the winding core and arranged to produce compressed-air jets directed in such a way that they guide the web tightly around the winding core within each area between the nips acting upon the winding core.

In the Finnish Pat. No. 49,276 a method is suggested for the winding of a web, wherein the web is wound onto a core while carried by a first carrier roll and by a second carrier roll and while pressed by an upper press roll against the web reel that is being wound. The complete web reel is removed by means of a lowering device, and, partly substantially simultaneously with the lowering movement of the web reel, a new core is shifted into the gap between the first carrier roll and the second carrier roll. The web is cut off without stopping the web, and the cut-off end of the web is attached to the core. The web starts being wound to make a new reel underneath the gap formed by the carrier rolls while supported by a lower press roll, whereupon the new reel is shifted by means of the lower press roll through the roll gap opened between the carrier rolls.

The Finnish Pat. No. 72,096 suggests a method and a device in the winding of a web. In this prior-art method the web is wound onto a core while supported by a first carrier roll and by a second carrier roll and while pressed by an upper press roll against the web reel that is being wound. The complete web reel is removed by means of a lowering device. Partly substantially simultaneously with the lowering movement of the web reel, a new core is shifted into the gap between the first carrier roll and the second carrier roll. The web is cut off preferably without stopping the web, and the cut-off end of the web is attached to the core. The complete reel is shifted to the lowering position with the aid of at least two lowering rolls so that the lowering rolls are raised along their path of movement so as to receive the complete reel, whereat the lowering rolls contact the reel after they have been accelerated to the correct surface speed.

In the corresponding prior-art methods and devices, the most important drawback has been the fact that it has not been possible to control the quality of winding sufficiently well. Likewise, problems have occurred in the lowering of the complete reel, and often the complete reel has been damaged on lowering.

The object of the present invention is to provide an improvement of the prior-art winding methods. A specific object of the invention is to provide a method which permits controlling of the quality of winding and performance of the lowering of the complete reel so that the drawbacks mentioned above are avoided. A further object of the invention is to provide a method wherein the large and heavy reeling drum does not have to be stopped at all or, at the maximum, for a very short time. The further objectives of the method of the invention and the advantages that are obtained thereby come out from the description of the invention.

The objects of the invention are achieved by means of a method which is mainly characterized in that for the removal of a complete reel and for starting a new winding, the winding is stopped and the press roll is raised off the complete reel and shifted rearwards relative the complete reel, the set of belt rolls is displaced in the lateral direction, a new core is shifted into the space defined by the first carrier roll, by the first roll in the set of belt rolls, and by the complete reel, the set of belt rolls is displaced back in the lateral direction and the press roll is displaced towards the new core, whereby the press roll is, at the same time, positioned to push the complete reel away from the first carrier roll, and, substantially at the same time, the second roll in the set of belt rolls is lowered in the vertical direction, so that the complete reel is positioned to move onto the lowering device.

An alternative method of the invention is mainly characterized in that for the removal of a complete reel and for starting a new winding, the winding is slowed down to the exchange speed and the press roll is raised off the complete reel and shifted rearwards relative the complete reel, the set of belt rolls is displaced in the lateral direction, a new core is shifted into the space defined by the first carrier roll, by the first roll in the set of belt rolls, and by the complete reel, the set of belt rolls is displaced back in the lateral direction and the press roll is displaced towards the new core, whereby the press roll is, at the same time, positioned to push the complete reel apart from the first carrier roll, and, substantially at the same time, the second roll in the set of belt rolls is lowered in the vertical direction, so that the complete reel is positioned to move onto the lowering device.

A further object of the invention is to provide an improvement of the prior-art solutions of devices. Another object of the invention is to provide a device which permits winding of the web without stopping the large and heavy reeling drum or in which the reeling drum has to be stopped for a very short time only.

The objects of the invention are achieved by means of a device which is mainly characterized in that the device includes a cutting blade, which is fitted so that it can pivot around the press roll, a first actuator, which is fitted so as to displace the set of belt rolls in the lateral direction, and a second actuator, which is fitted so as to displace the second roll in the set of belt rolls in the vertical direction.

By means of the method and the device in accordance with the invention, a number of remarkable advantages are obtained. By means of the method and the device of the invention, it is possible to control the winding of the web in a reliable way so that the quality of the web and, likewise, the quality of the winding can be made to remain very good. Likewise, the lowering of the complete reel has been solved so that damage to the complete reel can be avoided. The web exchange time is reduced considerably, because in the method and the device of the invention, the large and heavy reeling drum does not have to be stopped or has to be stopped for a very short time only. In the former case, if desired, the web can be run from the paper machine directly to a carrier-roll winder, in which case the quality of the web wound becomes good, because it is possible to use a slightly lower winding speed because of the continuous operation, which reduces the detrimental air flows etc. in the winding process. Also, the quantity of broke is reduced, because the web need not be wound first onto a reeling drum. Moreover, fewer machines and fewer people to operate them are required in the winding, whereby the costs are also reduced significantly.

The invention will be described in detail with reference to some advantageous embodiments of the invention illustrated in the accompanying drawings, whereat the invention is, however, not supposed to be confined to said embodiments alone.

Figure 1:
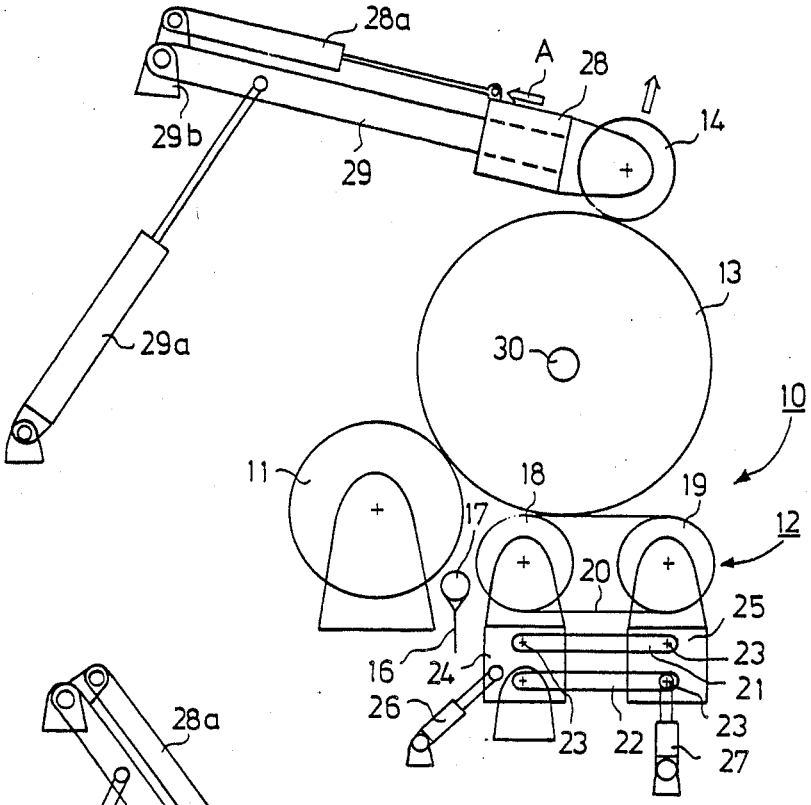
FIG. 1 shows a preferred embodiment of a device used in the method of the invention, as a schematical side view, in a situation in which the press roll rises up from the complete reel.

In the embodiment of FIGS. 1 to 5, the device in accordance with the invention is denoted generally with the reference numeral 10. In this embodiment, the device 10 includes a first carrier roll 11 and a second carrier roll 12, the web P being wound onto a core through the gap placed between said rolls, whereby the web P forms a complete roll 13. The device 10 further includes a press roll 14 and a lowering device 15, which is, in this embodiment, a dumping device. The device 10 further includes a core positioner 16, which is fitted underneath the gap between the carrier rolls 11 and 12. The core positioner 16 is fitted to displace the cores 17 from the position of FIG. 1 to the position of FIG. 3.

In this embodiment, the second carrier roll 12 is a carrier roll consisting of a so-called set of belt rolls. The set 12 of belt rolls includes a first roll 18, a second roll 19, and a belt 20. Moreover, in this embodiment, the set 12 of belt rolls includes lever arms 21 and 22 linked to fastening pieces 24 and 25 at the articulation points 23. The rhomboid formed by the levers 21 and 22 and by their fastening pieces 24 and 25 can be displaced by means of the cylinder 26. In this embodiment, the cylinder 26 is fitted so as to act upon the fastening piece 24. A cylinder 27 is fitted to act upon the other fastening piece 25, by means of which said cylinder 27 the position of the second roll 19 in the set 12 of belt rolls can be altered in the vertical direction. The frame construction of the press roll 14 is denoted with the reference numeral 28, and the arm on which the frame construction 28 is fitted displaceably with the reference numeral 29. The arm 29 can be pivoted by means of the cylinder **29*a* around the fastening point 29*b* of the arm 29. In a corresponding way, the cylinder 28*a* is fitted to displace the frame construction 28 and, at the same time, the press roll 14** in the direction indicated by the arrow A.

The operation of the device 10 in accordance with the invention in the embodiment shown in FIGS. 1 to 5 is as follows. In the situation of FIG. 1, the process is ready for exchange and the complete reel 13 has reached the desired reel size. A this point, the run of the winding has been stopped, and the press roll 14 rises from the complete reel 13 and moves, in the way denoted by the arrow A, rearwards relative the complete reel 13. A new core 17 is waiting to be passed in on the core positioner 16. The core locks 30 are opened and fall down to the lower position.

Figure 2:
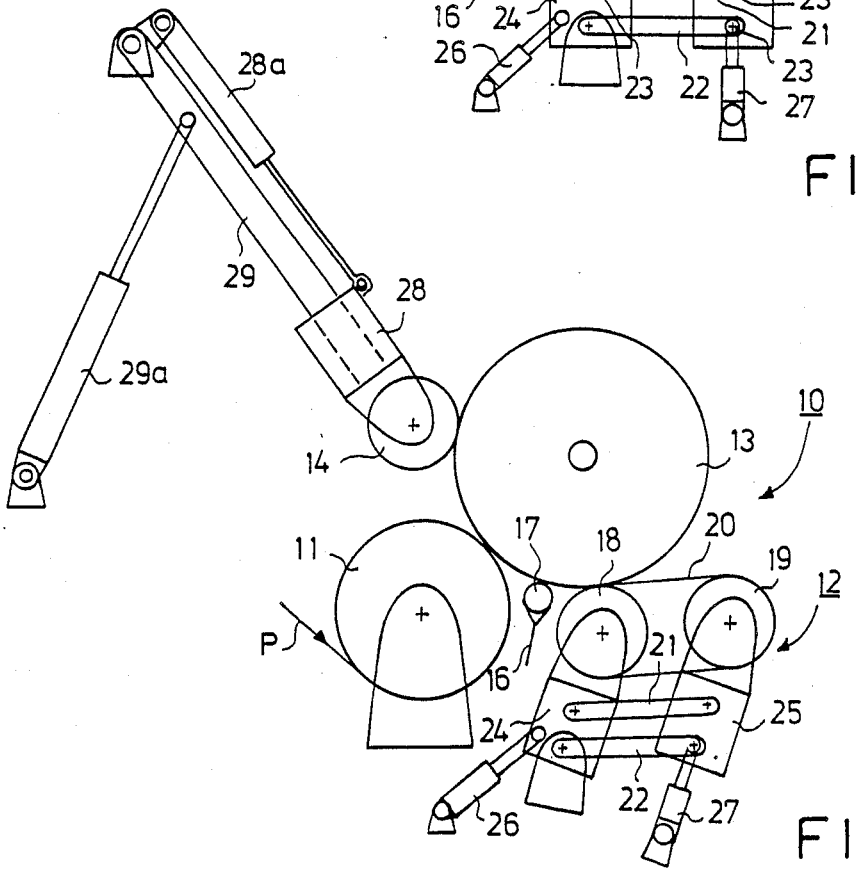
FIG. 2 shows the device shown in FIG. 1 in a situation in which the set of belt rolls formed by the second carrier roll is displaced in the lateral direction for the passing in of a new core.

In the situation shown in FIG. 2, for passing the new core 17 in, the set 12 of belt rolls is shifted by means of the cylinder 26, whereby the system formed by the levers 21 and 22 and by their fastening pieces 24 and 25 moves to the position shown in FIG. 2. The core 17 is placed by means of the core positioner 16 below the complete reel 13 between the first carrier roll 11 and the first roll 18 in the set 12 of belt rolls. The press roll 14 is waiting behind the complete reel 13 in the position shown in FIG. 2.

Figure 3:
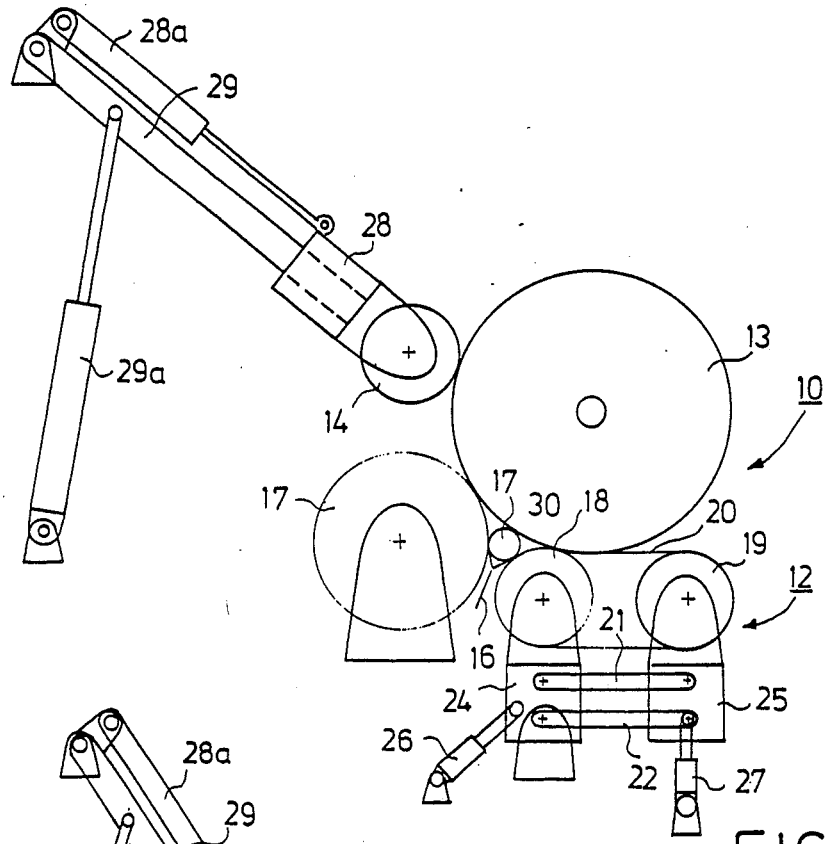
FIG. 3 shows the device of FIG. 1 in a situation in which the set of belt rolls is displaced back in the lateral direction.

In the situation shown in FIG. 3, the set 12 of belt rolls is shifted back, and the new core 17 remains in the space defined by the first carrier roll 11, by the first roll 18 in the set 12 of belt rolls, and by the complete reel 13. Thereupon the core locks 30 are closed and the core positioner 16, which has kept the new core 17 up, is moved down through the gap between the first carrier roll 11 and the first roll 18 in the set 12 of belt rolls. Removal of the complete reel 13 can then start.

Figure 4:
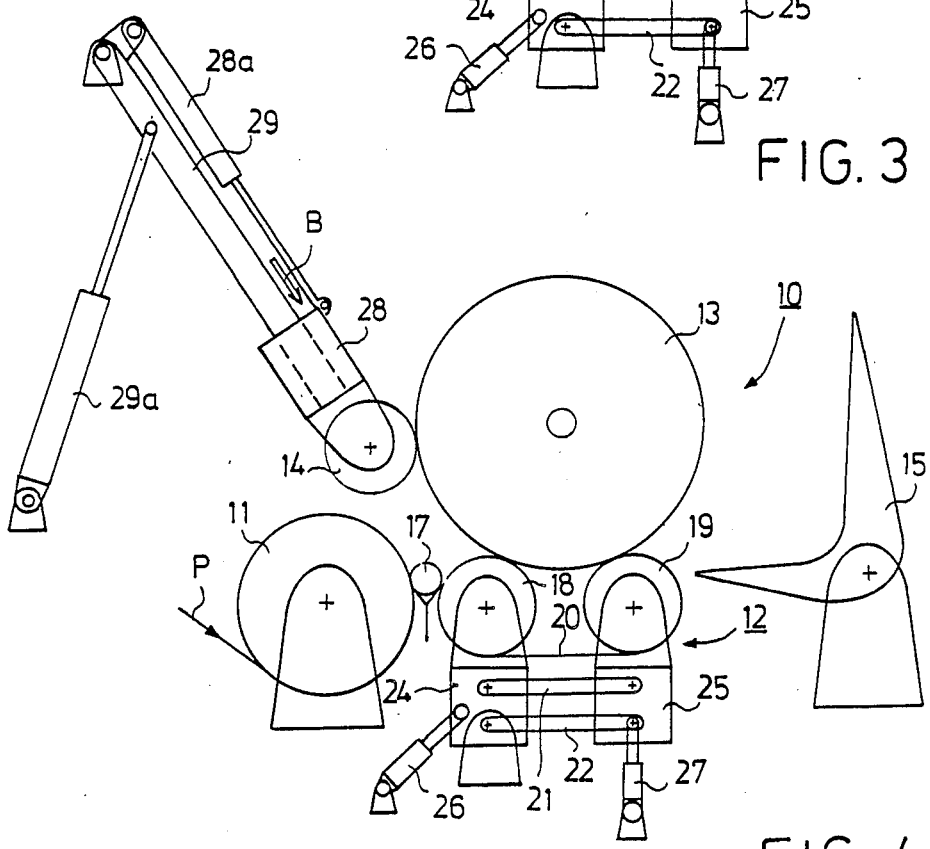
FIG. 4 shows the device of FIG. 1 in a situation in which the press roll moves towards the new core and, at the same time, pushes the complete reel towards the lowering device.

In the situation shown in FIG. 4, the press roll 14 is displaced in the way denoted by the arrow B towards the new core 17, in other words downwards, and, at the same time, pushes the complete reel 13 away from the first carrier roll 11 and towards the dumping device 15. At the same time, the second roll 19 in the set 12 of belt rolls is lowered by means of the cylinder 27. With this procedure, it is permitted that the lowering of the complete reel 13 is as soft as possible.

Figure 5:
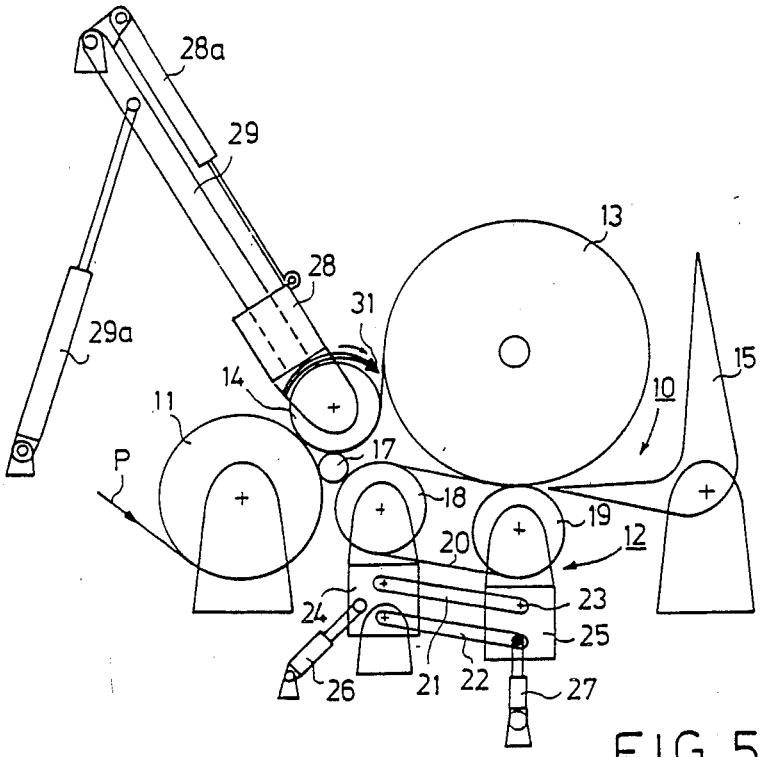
FIG. 5 shows the device of FIG. 1 in a situation in which the complete reel has been displaced far enough from the first carrier roll, so that the cutting device cuts off the web and new winding can start.
Figure 6:
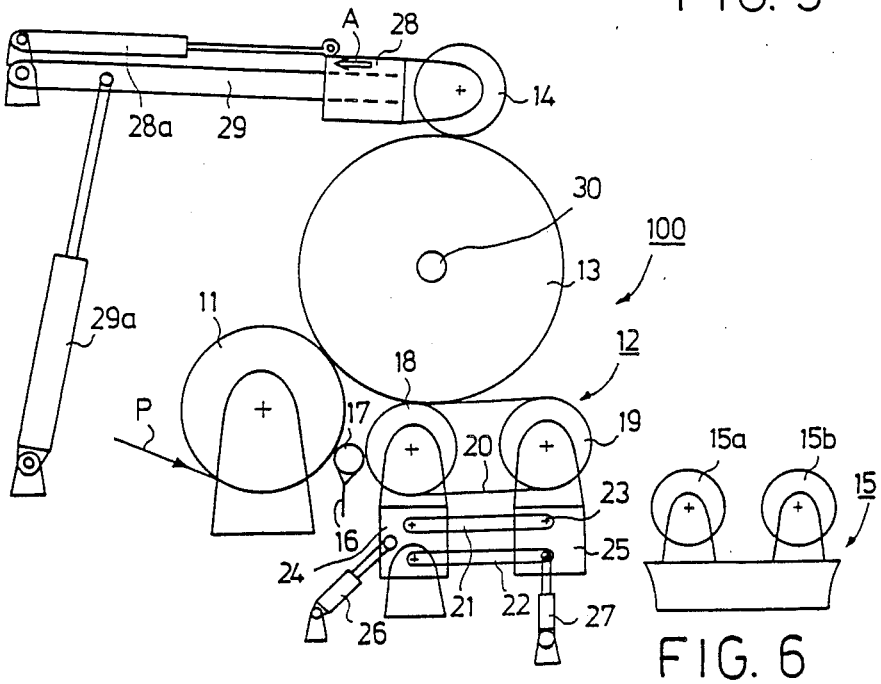
FIG. 6 shows a second preferred embodiment of the device used in the method of the invention as a schematical side view in a situation in which the press roll rises up from the complete reel.

In the situation shown in FIG. 5, the complete reel 13 is far enough from the first carrier roll 11 so that the cutting blade 31, which is fitted as pivotable around the press roll 14, is pivoted and cuts off the web P. At the same time, the complete reel 13 is ready to roll onto the dumping device 15. After the complete reel 13 has been removed onto the dumping device 15, the set 12 of belt rolls can be raised back to the upper position. This is, however, not necessary right at the beginning of the new winding. The end of the new web P can be made to turn around the new core 17 either by means of an adhesive agent, by means of a two-sided adhesive tape, or by making use of blowing for passing around. The attaching of the end of the web P to the new core 17 constitutes technology in itself known, for which reason it will not be discussed in connection with the present application in more detail. Hereupon, the running of new winding can start.

In the embodiment shown in FIGS. 6 to 10, the device in accordance with the invention is denoted generally with the reference numeral 100. In this embodiment the device 100 includes a first carrier roll 11 and a second carrier roll 12, the web P being wound onto a core through the gap between said rolls, whereby the web P forms a complete reel 13. The device 100 further includes a press roll 14 and a lowering rolls 15*a* and 15*b*. The device 100 further includes a core positioner 16, which is fitted below the gap placed between the carrier rolls 11 and 12. The core positioner 16 is fitted to displace the cores 17 from the position shown in FIG. 6 to the position shown in FIG. 7.

In this embodiment, the second carrier roll 12 is a carrier roll formed by a so-called set of belt rolls, whose construction is the same as in the embodiment shown in FIGS. 1 to 5.

The operation of the device 100 in accordance with the invention in the embodiment of FIGS. 6 to 10 is as follows. In the situation shown in FIG. 6 the process is ready for exchange, and the complete reel 13 has reached the desired reel size. The exchange takes place, without stopping the winding, as follows. The winding is slowed down to the exchange speed. The press roll 14 rises up from the complete reel 13 and moves in the way indicated by the arrow A rearwards relative the complete reel 13. The new core 17 is waiting to be passed in in the core positioner 16. The core locks 30 are opened and fall down to the lower position.

Figure 7:
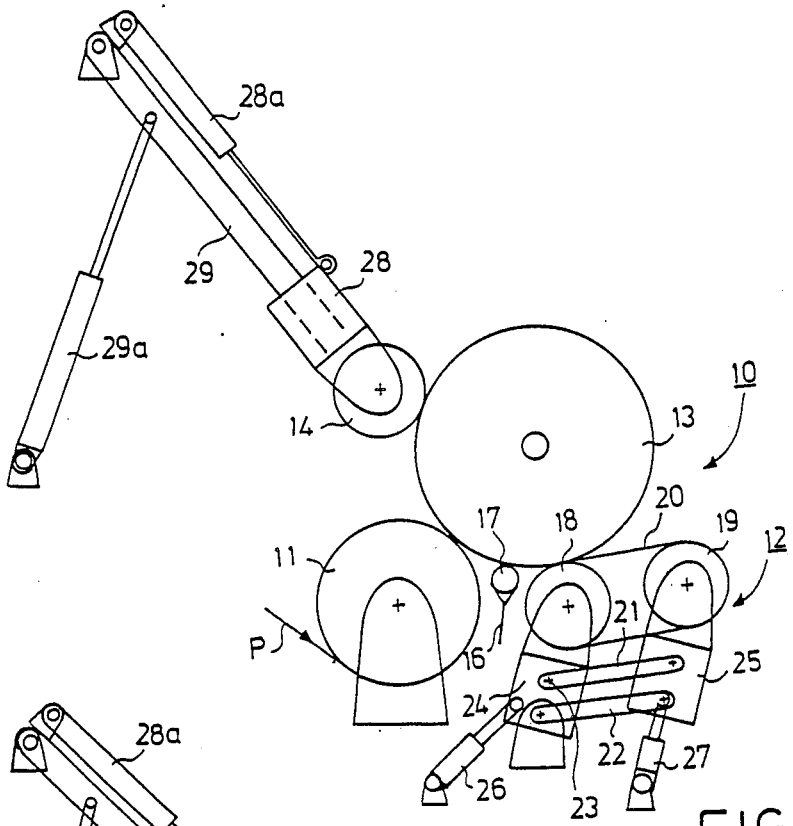
FIG. 7 shows the device of FIG. 6 in a situation in which the set of belt rolls formed by the second carrier roll is displaced in the lateral direction for the passing in of a new core.

In the situation shown in FIG. 7, for the positioning of the new core 17, the set 12 of belt rolls is shifted by means of the cylinder 26, whereby the system formed by the levers 21 and 22 and by their fastening pieces 24 and 25 moves to the position shown in FIG. 7. The core 17 is placed by means of the core positioner 16 below the complete reel 13 between the first carrier roll 11 and the first roll 18 in the set 12 of belt rolls. The press roll 14 is waiting behind the complete reel 13 in the position shown in FIG. 7.

Figure 8:
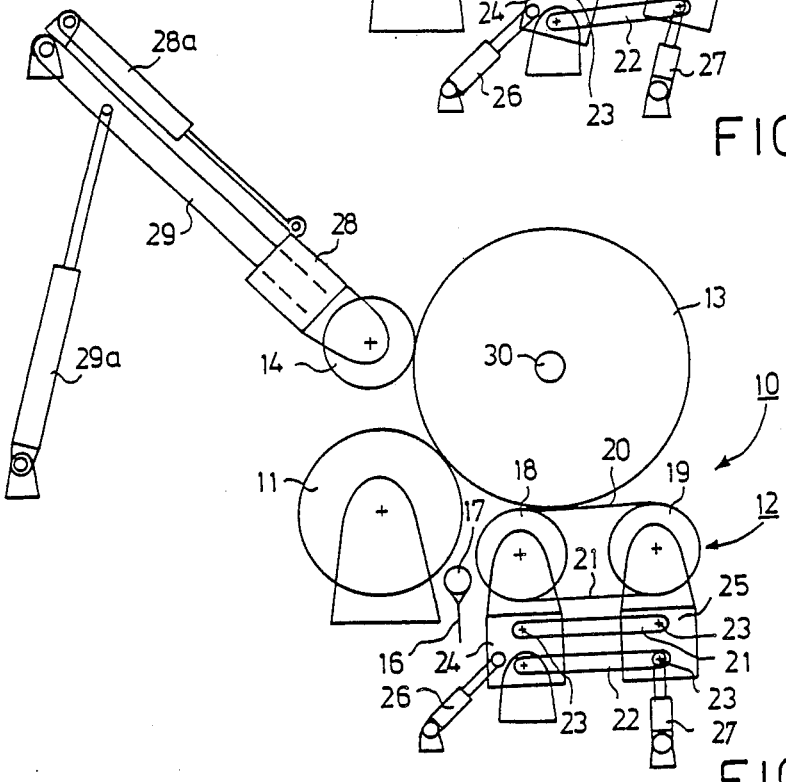
FIG. 8 shows the device of FIG. 6 in a situation in which the set of belt rolls is displaced back in the lateral direction.

In the situation shown in FIG. 8, the set 12 of belt rolls is shifted back and the new core 17 remains in the space defined by the first carrier roll 11, by the first roll 18 in the set 12 of belt rolls, and by the complete reel 13. The core locks 30 are then closed and the core positioner 16, which has kept the new core 17 up, is shifted down through the space between the first carrier roll 11 and the first roll 18 in the set 12 of belt rolls. Removal of the complete reel 13 can then start.

Figure 9:
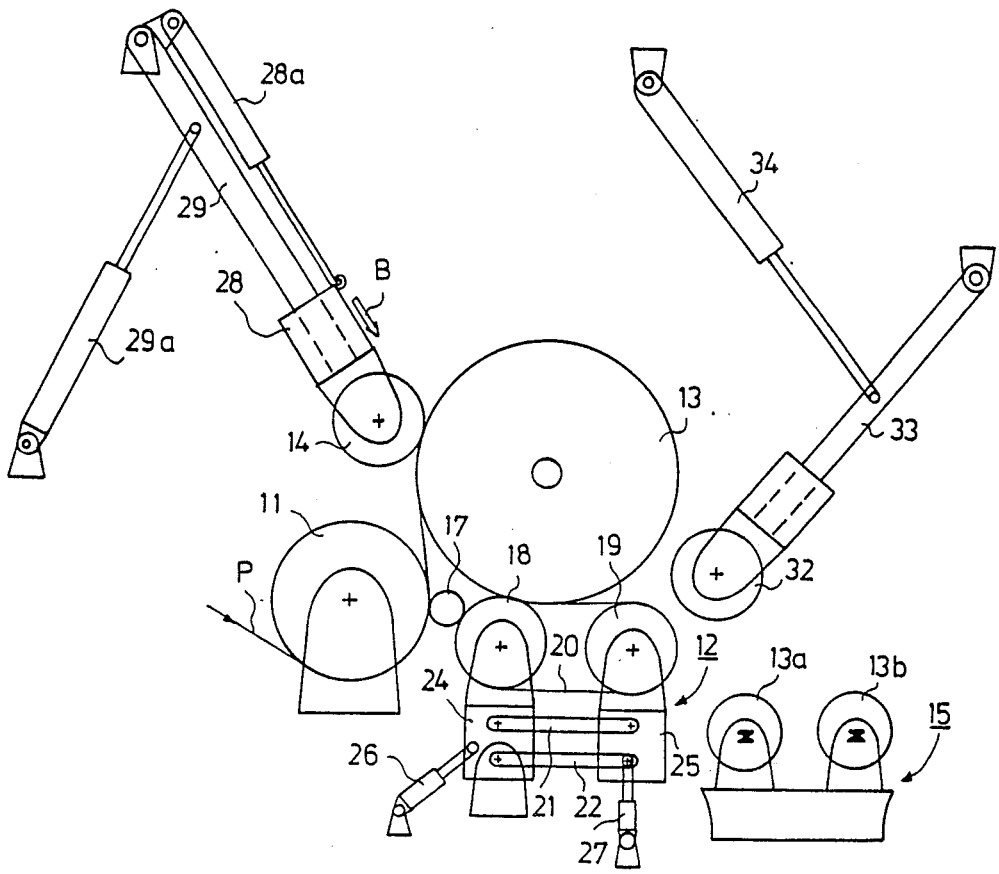
FIG. 9 shows the device of FIG. 6 in a situation in which the press roll moves towards the new core and, at the same time, pushes the complete reel towards the lowering device.

In the situation shown in FIG. 9, the press roll 14 is shifted in the way denoted by the arrow B towards the new core 17, in other words downwards, and, at the same time, pushes the complete reel 13 away from the first carrier roll 11. The complete reel 13 therefore moves towards the lowering rolls 15*a* and 15*b*. At the same time, the second roll 19 in the set 12 of belt rolls is lowered by means of the cylinder 27. The lowering rolls 15*a* and 15*b* are accelerated to the circumferential speed of the complete reel 13 without displacing them in any other respect. The counter-roll 32 has been displaced by means of the cylinder 34, which acts upon the arm 33, to wait at the front side of the complete reel 13. In this way it is permitted that the lowering of the complete reel 13 is as soft as possible.

Figure 10:
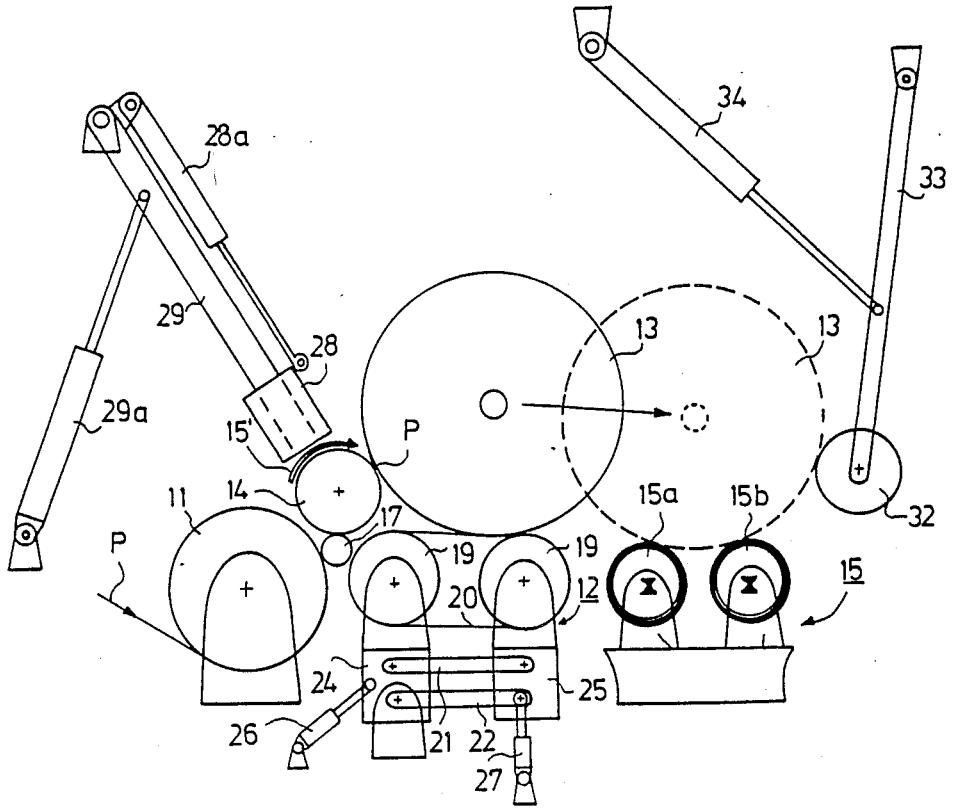
FIG. 10 shows the device of FIG. 6 in a situation in which the complete reel has been displaced far enough from the first carrier roll, so that the cutting device cuts off the web and new winding can start.

In the situation shown in FIG. 10, the complete reel 13 is far enough from the first carrier roll 11, so that the cutting blade 31, which is fitted pivotable around the press roll 14, is pivoted and cuts off the web P. At the same time, the complete reel 13 is ready to roll onto the lowering rolls 15*a* and 15*b*. The counter-roll 32 prevents the complete reel 13 from rolling too fast down from the roll 19 in the set 12 of belt rolls and escorts the reel 13 onto the lowering rolls 15*a* and 15*b*, which brake the reel 13 to full stop. Hereupon the reel 13 can be removed further onto the floor or onto a conveyor, e.g., by inclining the lowering rolls 15*a* and 15*b*. After the complete reel 13 has been removed from the roll 19 in the set 12 of belt rolls, the roll 19 in the set 12 of belt rolls can be raised back to the upper position. This is, however, not necessary right at the beginning of new winding. The end of the new web P can be made to turn around the new core 17 either by using an adhesive agent, by using a two-sided adhesive tape, or by means of blowing for passing around. The attaching of the end of the web P to the new core 17 constitutes technology in itself known, for which reason it will not be discussed in connection with the present application in more detail. Hereupon, the running of new winding can start, whereat the winding is accelerated to the winding speed.

What is claimed is:

1. A method of winding a web onto a succession of cores, comprising:

(a) locating a first core in a web winding position between a first carrier roll device and a second carrier roll device, said second carrier roll device comprising first and second belt rolls and the first belt roll being closer than the second belt roll to the first carrier roll device, (b) attaching a leading end of the web to the core in the winding position and rotating the core so as to wind the web onto the core and form a reel thereon, and concurrently employing a press roll to press the reel into contact with the carrier roll devices, (c) when the reel is completed, reducing the speed of rotation of the carrier roll devices, removing the press roll from contact with the complete reel, and shifting the press roll to a position over the first carrier roll device, (d) displacing the second carrier roll device away from the first carrier roll device and inserting a new core into the space defined between the first and second carrier roll devices and the complete reel and returning the second carrier roll device towards the first carrier roll device, (e) employing the press roll to push the complete reel away from the first carrier roll device, and substantially simultaneously lowering the second belt roll, whereby the completed reel is positioned for transfer to a reel lowering device.

2. A method according to claim 1, further comprising cutting the web, whereby a new leading end of the web is created.

3. A method according to claim 1, further comprising:

(f) repeating steps (b), (c), (d) and (e).

4. A method according to claim 2, comprising cutting the web during step (e).

5. A method according to claim 2, comprising cutting the web by means of a cutting blade mounted to pivot about the press roll.

6. A method according to claim 1, wherein step (e) comprises transferring the complete reel from the second carrier roll device to the reel lowering device, and the method further comprises subsequently raising the second belt roll.

7. A method according to claim 1, comprising using a dumping device as the reel lowering device.

8. A method according to claim 1, comprising using lowering rolls as the lowering device.

9. A method according to claim 1, wherein step (c) comprises stopping the rotation of the core.

10. A method according to claim 1, wherein step (c) comprises reducing the speed of rotation of the core such as to reduce the winding speed to an exchange speed.

11. A method according to claim 10, comprising using lowering rolls as the lowering device, transferring the complete reel to the lowering device, and accelerating the lowering rolls to the circumferential speed of the complete reel before the complete reel is transferred to the lowering device.

12. A method according to claim 1, comprising using a counter-roll to control transfer of the complete reel to the reel lowering device.

13. A method of winding a web onto a succession of cores, comprising:

(a) locating a first core in a web winding position defined between a first carrier roll and a second carrier roll, said second carrier roll device being closer than the third carrier roll to the first carrier roll, (b) attaching a leading end of the web to the core, rotating the core so as to wind the web onto the core and form a reel thereon, resting on the first and second carrier rolls, (c) when the reel is completed, reducing the speed of rotation of the core, (d) displacing the second carrier roll away from the first carrier roll while the complete reel rest on the first and second carrier rolls and inserting a new core into the space defined between the first and second carrier rolls and the complete reel and returning the second carrier roll towards the first carrier roll, and (e) pushing the complete reel away from the first carrier roll towards the third carrier roll, so that the complete reel is supported by the second and third carrier rolls, and lowering the third carrier roll, whereby the complete reel is positioned for transfer to a reel lowering device.

14. A method according to claim 13, further comprising cutting the web, whereby a new leading end of the web is created.

15. A method according to claim 13, further comprising:

(f) repeating steps (b), (c), (d) and (e).

16. Apparatus for winding a web onto a core, comprising:

a first carrier roll device, a second carrier roll device, which comprises first and second belt rolls of which the first is closer than the second to the first carrier roll device, the first and second carrier roll devices defining a web winding position therebetween for receiving the core, a press roll mounted to engage a reel being formed on the core when in the web winding position, whereby the first and second carrier roll devices form respective nips with the reel being wound in the winding position, a cutting blade mounted to pivot relative to the press roll for cutting the web when the reel is complete and creating a new leading end for attachment to a new core in the web winding position, means for displacing the second carrier roll device away from and towards the first carrier roll device, and means for displacing the second belt roll in the vertical direction relative to the first belt roll.

17. Apparatus according to claim 16, comprising an attachment arm whereby the press roll is mounted for pivotal movement relative to a support point, means for displacing the press roll longitudinally of the attachment arm, and means for pivoting the attachment arm about the support point.

18. Apparatus according to claim 16, wherein the reel lowering device comprises a dumping device.

19. Apparatus according to claim 16, wherein the reel lowering device comprises lowering rolls that can be accelerated to the circumferential speed of the complete reel before the complete reel is transferred to the lowering device.

20. Apparatus according to claim 16, comprising a counter-roll for controlling transfer of the complete reel to the lowering device.

* * * * *